US010548419B2

(12) United States Patent
Alletto

(10) Patent No.: US 10,548,419 B2
(45) Date of Patent: Feb. 4, 2020

(54) AIR MULTIPLIER PAD

(71) Applicant: BEDGEAR, LLC, Farmingdale, NY (US)

(72) Inventor: Eugene Alletto, Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 447 days.

(21) Appl. No.: 15/041,844

(22) Filed: Feb. 11, 2016

(65) Prior Publication Data

US 2017/0231407 A1 Aug. 17, 2017

(51) Int. Cl.

| | |
|---|---|
| ***A47G 9/02*** | (2006.01) |
| ***A47G 9/04*** | (2006.01) |
| ***A47C 21/04*** | (2006.01) |
| ***A47C 27/22*** | (2006.01) |

(52) U.S. Cl.

CPC ..... *A47G 9/02* (2013.01); *A47C 21/046* (2013.01); *A47C 27/22* (2013.01); *A47G 9/0215* (2013.01); *A47G 9/0238* (2013.01); *A47G 9/0261* (2013.01); *A47G 9/04* (2013.01)

(58) Field of Classification Search

CPC ..... A47G 9/00; A47G 9/02; A47G 9/0207; A47G 9/0215; A47G 9/0223; A47G 9/023; A47G 9/0238; A47G 9/0246; A47G 9/0261; A47G 9/04; A47G 9/0284; A47C 21/046; A47C 27/22

See application file for complete search history.

(56) References Cited

U.S. PATENT DOCUMENTS

| | | | | | |
|---|---|---|---|---|---|
| 1,569,955 | A * | 1/1926 | Falter | A47G 9/00 | 112/420 |
| 1,687,580 | A * | 10/1928 | Melcer | A47G 9/0284 | 5/502 |
| 2,087,505 | A * | 7/1937 | Davis | A47G 9/0207 | 428/6 |
| 2,271,281 | A * | 1/1942 | Whitman | A47C 27/00 | 139/291 R |
| 2,400,731 | A | 5/1946 | Armstrong | | |
| 3,047,887 | A * | 8/1962 | Koch | A47G 9/02 | 5/502 |

(Continued)

FOREIGN PATENT DOCUMENTS

| | | | |
|---|---|---|---|
| EP | 1114598 | A2 | 7/2001 |
| EP | 1114598 | A2 | 7/2017 |
| WO | WO-2017180687 | A1 * | 10/2017 |

OTHER PUBLICATIONS

TEC Microsystems, Thermoelectric Coolers Intro—The Basics (2018) https://www.tec-microsystems.com/faq/thermoelectric-coolers-intro.html (Year: 2018).*

(Continued)

*Primary Examiner* — David R Hare
(74) *Attorney, Agent, or Firm* — Sorell, Lenna & Schmidt, LLP

(57) ABSTRACT

A mattress topper is provided that includes opposite first and second end surfaces. The end surfaces each extend from a first side surface to a second side surface. The mattress topper includes a plurality of rows. Each of the rows include a quilting pattern defining a first pocket that extends from the first side surface to the second side surface, a second pocket that is enclosed within the first pocket and a third pocket that is enclosed within the second pocket.

20 Claims, 5 Drawing Sheets

(56) References Cited

U.S. PATENT DOCUMENTS 3,099,137 A * 7/1963 Ewing ..... A61F 7/007 62/3.5
3,508,284 A * 4/1970 Marquette ..... A47G 9/023 5/486
3,541,620 A * 11/1970 Chapuis ..... A47G 9/0207 2/272
3,584,323 A * 6/1971 Worley ..... A47G 9/086 2/69.5
3,801,420 A * 4/1974 Anderson ..... A47G 9/0207 428/102
4,132,262 A * 1/1979 Wibell ..... A47G 9/0215 165/206
4,748,703 A * 6/1988 Emi ..... A47G 9/0207 5/482
4,796,316 A * 1/1989 Boselli ..... A47C 21/046 5/652.1
4,839,934 A * 6/1989 Rojas ..... A47G 9/0207 5/485
4,884,304 A * 12/1989 Elkins ..... A47C 21/044 5/421
5,007,125 A * 4/1991 Owenby ..... A47G 9/0207 5/482
5,146,634 A * 9/1992 Hunt ..... A47G 9/0207 5/486
5,187,825 A * 2/1993 Tesch ..... A47G 9/0207 5/482
5,272,995 A * 12/1993 Harger ..... A47G 9/0284 112/1
5,386,602 A * 2/1995 Krenzler ..... A47G 9/086 2/69.5
5,408,712 A * 4/1995 Brun ..... A47G 9/0207 5/486
5,463,785 A * 11/1995 McKeel ..... A47D 15/001 5/655
5,488,746 A 2/1996 Hudson
5,513,403 A * 5/1996 Wooten, Jr. ..... A47G 9/0246 112/418
5,552,205 A * 9/1996 Lea ..... A41D 31/0038 428/74
5,697,113 A 12/1997 Shatz et al.
5,855,032 A * 1/1999 Field ..... A47G 9/0207 2/65
5,870,785 A * 2/1999 Hoorens ..... A47C 31/006 442/304
5,887,299 A * 3/1999 Phillips ..... A47G 9/0207 5/413 R
5,887,304 A 3/1999 Von Der Heyde
6,354,099 B1 3/2002 Bieberich
6,511,125 B1 1/2003 Gendron
6,523,354 B1 * 2/2003 Tolbert ..... A47G 9/0215 607/108
6,618,881 B2 * 9/2003 Hart ..... A47G 9/0207 5/482
6,684,437 B2 2/2004 Koenig
6,934,985 B2 8/2005 Sanders
6,961,970 B2 * 11/2005 Pedersen ..... A47G 9/0207 5/486
7,003,821 B2 2/2006 DeHart et al.
7,055,192 B2 6/2006 Waters et al.
7,107,638 B2 9/2006 Wilson
7,150,055 B2 * 12/2006 Wootten, Jr. ..... A47G 9/0207 5/502
7,249,389 B2 * 7/2007 Russell ..... A47G 9/0261 5/490
7,316,039 B2 * 1/2008 Wootten, Jr. ..... A47G 9/0246 5/497
7,469,432 B2 12/2008 Chambers
7,523,513 B2 4/2009 Waters et al.
7,566,846 B1 * 7/2009 Sorensen ..... H05B 1/02 2/905
7,712,164 B2 5/2010 Chambers
8,011,041 B2 9/2011 Hann
8,129,295 B2 * 3/2012 Aasgaard ..... D03D 13/008 442/301
8,220,088 B2 7/2012 Waters et al.
8,561,229 B2 * 10/2013 Regan ..... A47G 9/0207 5/482
8,707,482 B1 * 4/2014 Ramthun ..... A47G 9/0246 5/496
8,769,743 B2 * 7/2014 Sanders ..... A47C 27/007 5/500
2003/0204910 A1 * 11/2003 Buswell ..... A47G 9/0207 5/486
2004/0139552 A1 * 7/2004 Walters, Jr. ..... A47C 27/005 5/737
2007/0000050 A1 1/2007 Wu
2009/0113628 A1 * 5/2009 Hui ..... A47G 9/086 5/413 R
2009/0222995 A1 9/2009 Perry et al.
2011/0289684 A1 12/2011 Parish et al.
2012/0005831 A1 1/2012 Waters et al.
2012/0065547 A1 3/2012 Hann
2013/0230688 A1 * 9/2013 Wu ..... F16L 59/02 428/116
2014/0099468 A1 * 4/2014 Cai ..... A47G 9/0207 428/74
2017/0208958 A1 * 7/2017 Alletto, Jr. ..... A47C 27/002
2017/0295961 A1 * 10/2017 Alletto ..... A47G 9/0215

OTHER PUBLICATIONS

International Search Report and Written Opinion—PCT/US2017/017430 mailed from International Searching Authority European Patent Office dated Jun. 9, 2017.

International Application No. PCT/US2017/017430 International Search Report, Written Opinion of the International Searching Authority, International Preliminary Report on Patent ability dated Aug. 14, 2018 from International Bureau of WIPO, Geneva, Switzerland.

* cited by examiner

AIR MULTIPLIER PAD

TECHNICAL FIELD

The present disclosure generally relates to bedding, and more particularly to air multiplier pads that may be positioned on top of a mattress to prevent heat buildup between a sleep surface and a mattress, to provide thermal passage and to prevent sweat from a sleeper's body from soaking into the mattress.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable, in order to achieve restful sleep.

Typically, a bed sheet is positioned on top of a mattress and one or more sleepers rest their body(ies) on top of the bed sheet. However, when a sleeper rests his or her body on top of a bed sheet, heat from the sleeper's body radiates through the bed sheet to the mattress below the bed sheet. Some mattresses, such as, for example, memory foam mattresses, trap the body heat between the bed sheet and the mattress, due to among other things, the material the mattress is made from. That is, the material the mattress is made from collects heat from the sleeper's body, thus causing the temperature of the sleep surface to increase as the heat moves from a top surface of the mattress and through the bed sheet, which often causes the sleeper to sweat and prevents restful sleep. As the sleeper sweats, the sweat permeates through the bed sheet and eventually soaks into the mattress, thus causing the mattress to be damp and odorous, which can further prevent restful sleep. This disclosure describes an improvement over these prior art technologies.

SUMMARY

In one embodiment, in accordance with the principles of the present disclosure, an air multiplier pad, such as, for example a mattress topper is provided. The mattress topper is configured to be positioned between a mattress and a bed sheet that is positioned over the mattress and the mattress topper. The mattress topper includes opposite first and second end surfaces. The end surfaces each extend from a first side surface to a second side surface. The mattress topper comprises a quilting pattern that defines a first pocket that extends from the first side surface to the second side surface, a second pocket that is enclosed within the first pocket and a third pocket that is enclosed within the second pocket.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
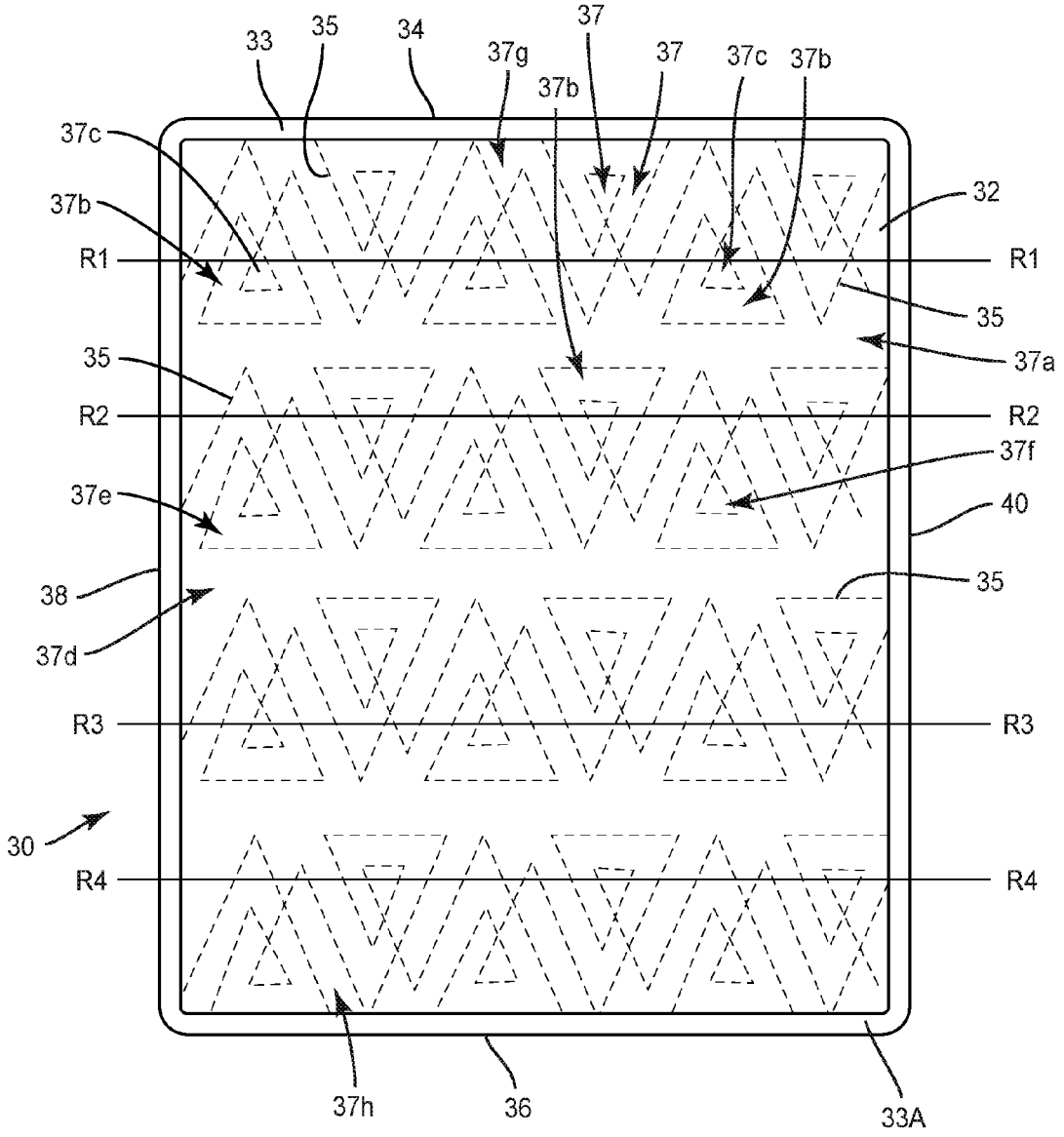
FIG. 1 is a top view, in part phantom, of one embodiment of an air multiplier pad, such as, for example, a mattress topper in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a mattress topper in accordance with the principles of the present disclosure. Alternate embodiments are also disclosed. Reference will now be made in detail to the exemplary embodiments of the present disclosure, which are illustrated in the accompanying figures. Turning to FIGS. 1-6, there are illustrated components of an air multiplier pad, such as, for example, a mattress topper 30.

Mattress topper 30 is configured to lie on top of a mattress. In some embodiments, mattress topper 30 is configured to cover all or a portion of a top surface of the mattress. In some embodiments, mattress topper 30 is configured to be larger than the top surface of the mattress such that at least a portion of mattress topper 30 covers all or a portion of a side surface of the mattress. In some embodiments, mattress topper 30 has substantially the same size and shape as the top surface of the mattress. In some embodiments, the mattress is a standard size mattress, such as, for example, a twin mattress, a full mattress, a queen mattress, a king mattress, or a California king mattress. In some embodiments, the mattress is a crib mattress. In some embodiments, the mattress is a memory foam mattress, an orthopedic mattress (with or without springs), a foam mattress, a mattress that includes gel, a crib mattress, a couch mattress or lounge pad.

Mattress topper 30 includes various surface fabrics and/or quilting patterns that are configured to allow warm air from a sleeper's body to be trapped within mattress topper 30, and then dissipated away from the sleeper, thus preventing the warm air from circulating back to the sleep surface. At the same time, ambient air from the external environment may pass through to the sleeper. In some embodiments, mattress topper 30 is configured to collect sweat from a sleeper's body, and then dissipated away from the sleeper, so that the sweat does return to the sleeper, creating dampness, nor soak into a mattress that is positioned below mattress topper 30.

Mattress topper 30 includes a top layer, such as, for example, a panel 32. Panel 32 comprises an end surface 34 and an opposite end surface 36. Surfaces 34, 36 extend between opposite side surfaces 38, 40. Surfaces 34, 36, 38 and 40 are edges of panel 32 that define a perimeter of panel 32. In some embodiments, panel 32 is rounded at all four corners. That is, panel 32 is rounded between surface 34 and 38, between surface 34 and surface 40, between surface 36 and surface 38 and between surface 36 and surface 40. In embodiments wherein panel 32 is rounded at all four corners, panel 32 resembles a rounded rectangle. This configuration allows panel 32 to conform to the shape of a conventional mattress. In some embodiments, surface 34 may be disposed at alternate orientations relative to surface 36, such as, for example, parallel, transverse and/or other angular orientations such as acute or obtuse, tapered, and/or may be offset or staggered. Likewise, in some embodiments, surface 38 may be disposed at alternate orientations relative to surface 40, such as, for example, parallel, transverse and/or other angular orientations such as acute or obtuse, tapered, and/or may be offset or staggered. In some embodiments, panel 32 is variously shaped, such as, for example, oval, oblong, triangular, square, polygonal, irregular, uniform, non-uniform, offset, staggered, undulating, arcuate, variable and/or tapered, depending upon, for example, the shape of the mattress on which mattress topper 30 is being placed.

Mattress topper 30 includes a bottom layer, such as, for example, panel 32A opposite panel 32. Panel 32A comprises an end surface 34A and an opposite end surface 36A. Surface 34A engages surface 34 and surface 36A engages surface 36. Surfaces 34A, 36A extend between opposite side surfaces 38A, 40A. Surface 38A engages surface 38 and surface 40A engages surface 40. Surfaces 34A, 36A, 38A and 40A are edges of panel 32A that define a perimeter of panel 32A. In some embodiments, panel 32A is rounded at all four corners. That is, panel 32A is rounded between surface 34A and 38A, between surface 34A and surface 40A, between surface 36A and surface 38A and between surface 36A and surface 40A. In embodiments wherein panel 32A is rounded at all four corners, panel 32A resembles a rounded rectangle. This configuration allows panel 32A to conform to the shape of a conventional mattress. In some embodiments, surface 34A may be disposed at alternate orientations relative to surface 36A, such as, for example, parallel, transverse and/or other angular orientations such as acute or obtuse, tapered, and/or may be offset or staggered. Likewise, in some embodiments, surface 38A may be disposed at alternate orientations relative to surface 40A, such as, for example, parallel, transverse and/or other angular orientations such as acute or obtuse, tapered, and/or may be offset or staggered. In some embodiments, panel 32A is variously shaped, such as, for example, oval, oblong, triangular, square, polygonal, irregular, uniform, non-uniform, offset, staggered, undulating, arcuate, variable and/or tapered, depending upon, for example, the shape of the mattress that in which mattress topper 30 is being placed.

Figure 4:
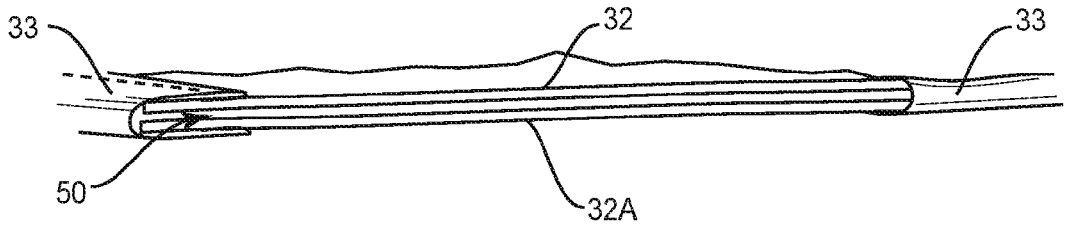
FIG. 4 is a cross sectional view of the mattress topper shown in FIG. 1.

Mattress topper 30 comprises binding 33 that covers panels 32, 32A to join panels 32, 32A together. In some embodiments, binding 33 covers surfaces 34, 34A, 36, 36A, 38, 38A, 40 and 40A. That is, binding 33 is positioned about surfaces 34, 34A, 36, 36A, 38, 38A, 40 and 40A such that an inner surface of binding 33 engages outer surfaces of panels 32, 32A, as shown in FIG. 4. In some embodiments, binding 33 joins panels 32, 32A via stitching 33A that extends through the outer surface of binding 33 a first time, through opposite inner and outer surfaces of panel 32, through opposite inner and outer surfaces of panel 32A and then through the outer surface of binding 33 a second time, as shown in FIG. 4. In some embodiments, binding 33 is rib knit jersey binding. In some embodiments, mattress topper 30 includes single unit, such as, for example, a single unit that is made up of panel 32 and panel 32A, wherein panels 32, 32A are joined by binding 33 and panels 32, 32A and binding are bound together by stitching 33A. As such, the single unit cannot be taken apart without removing stitching 33A.

When panels 32, 32A are joined by binding 33, a distance between opposite outer surfaces of panels 32, 32A defines a maximum height of mattress topper 30. In some embodiments, mattress topper 30 has a maximum height between about 0.10 inches and about 1.0 inch. In some embodiments, mattress topper 30 has a maximum height between about 0.20 inches and about 0.5 inches. In some embodiments, mattress topper 30 has a maximum height between about 0.20 inches and about 0.3 inches. In some embodiments, mattress topper 30 has a maximum height of 0.25 inches. As would be recognized by one of ordinary skill in the art, the maximum height of mattress topper 30 should be reduced as much as possible when mattress topper 30 is positioned on top of a mattress that is configured to conform to a sleeper's body, such as, for example, a memory foam mattress. Indeed, memory foam mattresses rely upon the weight of the sleeper to create an imprint in the mattress to conform the memory foam to the shape of the user's body. If the height of mattress topper 30 were too great, the memory foam would not get a proper imprint of the sleeper's body, as mattress topper 30 would disperse the weight of the sleeper's body over a greater area. As such, there must be a balance wherein mattress topper 30 has a height that is not too great to prevent the memory foam from obtaining a proper imprint of the sleeper's body and not too little to prevent heat from the user's body from being contained within pockets and dissipated via channels in mattress topper 30, as discussed herein. In some embodiments, mattress topper 30 is configured for use with other types of mattresses, such as, for example, conventional mattresses. It is therefore envisioned that the maximum height of mattress topper 30 can be between about 0.05 inches and 3 inches. In some embodiments, mattress topper 30 has a maximum height that is greater than 3 inches. In one embodiment the maximum height of mattress topper 30 is about 1.5 inches.

In some embodiments, panels 32, 32A are each made from a first material. In some embodiments, the first material comprises a porous base material. In some embodiments, the first material comprises a breathable material configured to create enhanced airflow to the sleep surface. In some embodiments, the first material comprises pores that are defined by fibers or strands of the first material, such as, for example, a fabric that makes up the first material. That is, the pores of the first material are the spaces between the fibers or strands of the first material. In some embodiments, the pores have a random configuration (size, shape and/or spacing) that is determined by the arrangement of the fibers or strands of the first material. In some embodiments, the first material has pores that are evenly spaced apart from one another. In some embodiments, the pores are variously shaped, such as, for example, oval, oblong, triangular, square, polygonal, irregular, uniform, non-uniform, offset, staggered, undulating, arcuate, variable and/or tapered. In some embodiments, the first material is a moisture dispersing material. In some embodiments, the first material is a breathable material, such as, for example a breathable fabric. In some embodiments, the first material comprises acrylic, acetate, cotton, linen, silk, polyester, wool, nylon, rayon, spandex, lycra, hemp, manmade materials, natural materials (e.g., hemp) and blends and/or combinations thereof. Particular materials or blends of materials used are selected according the particular characteristics, price point, durability, and appearance to be achieved.

In some embodiments, panel 32 is made from a material that is different from the material panel 32A is made from. For example, panel 32 or panel 32 may be made from the first material described above and the other one of panel 32 and panel 32A may be made from a material that is different from the first material. Panel 32 may be made from a material that comprises acrylic, acetate, cotton, linen, silk, polyester, wool, nylon, rayon, spandex, lycra, hemp, manmade materials, natural materials (e.g., hemp) and blends and/or combinations thereof, and panel 32A may be made from a material that is different from the material panel 32 is made from. The material panel 32A is made from comprises acrylic, acetate, cotton, linen, silk, polyester, wool, nylon, rayon, spandex, lycra, hemp, manmade materials, natural materials (e.g., hemp) and blends and/or combinations thereof. In one embodiment, panel 32 is made from a breathable fabric and panel 32A is made from a double-layered 3D mesh fabric.

In some embodiments, panels 32, 32A each include a single layer of material, such as, for example, a single layer of fabric. In some embodiments, at least one of panels 32, 32A includes multiple layers of material, such as, for example, fabric. A temperature-regulating material, such as a gel, may be applied interiorly to panel 32 and/or panel 32A to provide cooling and/or warming functionality. The temperature-regulating material may be silicon or polyether gel formed into layers and applied shapes, as well as, formed ceramics, neoprene and other material technology for use to perform heat transfer and temperature regulation function. Depending on the nature and stability of the temperature-regulating material, the temperature-regulating material may be applied internally and/or externally to panel 32 and/or panel 32A.

In some embodiments, panels 32, 32A each include a single layer of fabric. In some embodiments, panels 32, 32A each include multiple layers of fabric. In some embodiments, at least one of panels 32, 32A may include a water resistant or waterproof finish or material. That is, an outer surface of at least one of panels 32, 32A may include a water resistant or waterproof finish or material that prevents water and/or other liquids from entering an interior cavity of mattress topper 30 and/or penetrating into panel 32 or panel 32A. In some embodiments, the water resistant or waterproof finish or material is gas permeable to allow air to move through mattress topper 30.

In some embodiments, mattress topper 30 includes stitching 35 that extends through inner and outer surfaces of panel 32 and panel 32A. Stitching 35 is used to form one or a plurality of pockets 37 between panel 32 and panel 32A. In some embodiments, pockets 37 are defined by inner surfaces of panels 32, 32A that face one another and stitching 35. In some embodiments, pockets 37 are defined by the inner surfaces of panels 32, 32A that face one another, stitching 33A and stitching 35. Pockets 37 are configured to trap heat from a user's body that moves through a bed sheet and into mattress topper 30 to prevent the heat from returning to the sleep surface, so as not to increase the temperature of the sleep surface, as discussed above. As would be recognized by one of ordinary skill in the art, a single pocket or a series of pockets that are positioned side-by-side across a width of mattress topper 30 or top-to-bottom along a length of mattress topper 30 would be insufficient to properly trap heat within mattress topper 30. As such, mattress topper 30 includes a plurality of pockets 37, wherein some of pockets 37 are positioned within other pockets 37. It has been found that this configuration of pockets 37 properly contains heat from a sleeper's body within pockets 37 in a manner that prevents the heat within pockets 37 from returning to the sleep surface. In some embodiments, heated air within pockets 37 will move through panel 32 and/or panel 32A and into an environment, such as, for example, a room, wherein the ambient temperature in the environment is less than the temperature of the air within pockets 37. This will lower the temperature of the air within pockets 37, thus preventing mattress topper 30 from feeling to warm or hot to the sleeper.

In some embodiments, mattress topper 30 comprises a first pocket 37, such as, for example, a first pocket 37*a* that extends from surface 38 to surface 40, and a second pocket 37, such as for example, a second pocket 37*b* that is enclosed within first pocket 37*a*, as shown in FIG. 1. First pocket 37*a* is defined by the inner surfaces of panels 32, 32A that face one another, stitching 33A and stitching 35. In some embodiments, mattress topper 30 comprises a plurality of second pockets 37*b* enclosed within first pocket 37*a*, as shown in FIG. 1. Second pockets 37*b* are defined by the inner surfaces of panels 32, 32A that face one another and stitching 35. Second pockets 37*b* are spaced apart from stitching 33A. In some embodiments, second pockets 37*b* each have the same configuration. However, in some embodiments, second pockets 37*b* may have similar or different configurations, such as, for example, shapes and/or sizes. That is, second pockets 37*b* may have identical shapes, sizes and/or configurations or different shapes, sizes and/or configurations. In some embodiments, second pockets 37*b* are evenly spaced apart from one another. In some embodiments, first pocket 37*a* and/or at least one of second pockets 37*b* is variously shaped, such as, for example, circular, oval, oblong, triangular, square, polygonal, irregular, uniform, non-uniform, offset, staggered, undulating, arcuate, variable and/or tapered.

In some embodiments, mattress topper 30 may include a third pocket 37, such as, for example, a third pocket 37*c* enclosed within at least one of second pockets 37*b*, as shown in FIG. 1. In some embodiments, mattress topper 30 includes a third pocket 37*c* enclosed within each of second pockets 37*b*, as shown in FIG. 1. Third pockets 37*c* are defined by the inner surfaces of panels 32, 32A that face one another and stitching 35. Third pockets 37*c* are spaced apart from stitching 33A. In some embodiments, third pockets 37*c* each have the same configuration. However, in some embodiments, third pockets 37*c* may have similar or different configurations, such as, for example, shapes and/or sizes. That is, third pockets 37*c* may have identical shapes, sizes and/or configurations or different shapes, sizes and/or configurations. In some embodiments, third pockets 37*c* are evenly spaced apart from one another. In some embodiments, mattress topper 30 includes a second pocket 37*b* and a third pocket 37*c* positioned between two-second pockets 37*b* and two third pockets 37*c*. In some embodiments, at least one of third pockets 37*c* is variously shaped, such as, for example, circular, oval, oblong, triangular, square, polygonal, irregular, uniform, non-uniform, offset, staggered, undulating, arcuate, variable and/or tapered.

In some embodiments, first pocket 37*a* includes a first row, such as, for example, row R1, shown in FIG. 1, that includes a plurality of second pockets 37*b* and a plurality of third pockets 37*c* that are each positioned within one of second pockets 37*b* in row R1. First pocket 37*a* also includes a second row, such as, for example, row R2, shown in FIG. 1, that includes a plurality of second pockets 37*b* and a plurality of third pockets 37*c* that are each positioned within one of second pockets 37*b* in row R2. As shown in FIG. 1, second pockets 37*b* in row R1 are spaced apart from second pockets 37*b* in row R2.

In some embodiments, mattress topper 30 includes a fourth pocket 37, such as, for example, a fourth pocket 37*d* that extends from surface 38 to surface 40, and a fifth pocket 37, such as for example, a fifth pocket 37*e* that is enclosed within fourth pocket 37*d*, as shown in FIG. 1. In some embodiments, fourth pocket 37*d* abuts first pocket 37*a*. That is, the same stitching 35 that defines a portion of first pocket 37*a* defines at least a portion of fourth pocket 37*d*. In some embodiments, fourth pocket 37*d* has the same configuration as first pocket 37*a*. However, in some embodiments, fourth pocket 37*d* has a different configuration from first pocket 37*a*. That is, fourth pocket 37*d* may have an identical shape, size and/or configuration as first pocket 37*a* or a different shape, size and/or configuration than first pocket 37*a*. Fourth pocket 37*d* is defined by the inner surfaces of panels 32, 32A that face one another, stitching 33A and stitching 35. In some embodiments, mattress topper 30 comprises a plurality of fifth pockets 37*e* enclosed within fourth pocket 37*d*, as shown in FIG. 1. Fifth pockets 37*e* are defined by the inner surfaces of panels 32, 32A that face one another and stitching 35. Fifth pockets 37*e* are spaced apart from stitching 33A. In some embodiments, fifth pockets 37*e* each have the same configuration. However, in some embodiments, fifth pockets 37*e* may have similar or different configurations, such as, for example, shapes and/or sizes. That is, fifth pockets 37*e* may have identical shapes, sizes and/or configurations or different shapes, sizes and/or configurations. In some embodiments, fifth pockets 37*e* are evenly spaced apart from one another. In some embodiments, fourth pocket 37*d* and/or at least one of fifth pockets 37*e* is variously shaped, such as, for example, circular, oval, oblong, triangular, square, polygonal, irregular, uniform, non-uniform, offset, staggered, undulating, arcuate, variable and/or tapered.

In some embodiments, mattress topper 30 may include a sixth pocket 37, such as, for example, a third pocket 37*f* enclosed within at least one of fifth pockets 37*e*, as shown in FIG. 1. In some embodiments, mattress topper 30 includes a sixth pocket 37*f* enclosed within each of fifth pockets 37*e*, as shown in FIG. 1. Sixth pockets 37*f* are defined by the inner surfaces of panels 32, 32A that face one another and stitching 35. Sixth pockets 37*f* are spaced apart from stitching 33A. In some embodiments, sixth pockets 37*f* each have the same configuration. However, in some embodiments, sixth pockets 37*f* may have similar or different configurations, such as, for example, shapes and/or sizes. That is, sixth pockets 37*f* may have identical shapes, sizes and/or configurations or different shapes, sizes and/or configurations. In some embodiments, sixth pockets 37*f* are evenly spaced apart from one another. In some embodiments, mattress topper 30 includes a fifth pocket 37*e* and a sixth pocket 37*f* positioned between two fifth pockets 37*e* and two sixth pockets 37*f*. In some embodiments, at least one of sixth pockets 37*f* is variously shaped, such as, for example, circular, oval, oblong, triangular, square, polygonal, irregular, uniform, non-uniform, offset, staggered, undulating, arcuate, variable and/or tapered.

In some embodiments, fourth pocket 37*d* includes a first row, such as, for example, row R3, shown in FIG. 1, that includes a plurality of fifth pockets 37*e* and a plurality of sixth pockets 37*f* that are each positioned within one of fifth pockets 37*e* in row R3. Fourth pocket 37*d* also includes a second row, such as, for example, row R4, shown in FIG. 1, that includes a plurality of fifth pockets 37*e* and a plurality of sixth pockets 37*f* that are each positioned within one of fifth pockets 37*e* in row R4. As shown in FIG. 1, fifth pockets 37*e* in row R3 are spaced apart from fifth pockets 37*e* in row R4.

In some embodiments, mattress topper 30 may include at least one additional pocket 37, such as, for example, pocket 37*g*, that has the same or a similar configuration as first pocket 37*a* and is positioned opposite fourth pocket 37*d*. First pocket 37*a* is positioned between fourth pocket 37*d* and pocket 37*g*. In some embodiments, pocket 37*g* abuts first pocket 37*a*. That is, the same stitching 35 that defines a portion of first pocket 37*a* defines at least a portion of pocket 37*g*. Likewise, mattress topper 30 may include at least one additional pocket 37, such as, for example, pocket 37*h*, that has the same or a similar configuration as first pocket 37*a* or fourth pocket 37*d* and is positioned opposite first pocket 37*a*. Fourth pocket 37*d* is positioned between first pocket 37*a* and pocket 37*h*. In some embodiments, pocket 37*h* abuts fourth pocket 37*d*. That is, the same stitching 35 that defines a portion of fourth pocket 37*d* defines at least a portion of pocket 37*h*. It is envisioned that the number of additional pockets, such as, for example, pocket 37*g* and/or pocket 37*h* may depend upon the length of mattress topper 30 and/or the size of first pocket 37*a* and/or fourth pocket 37*d*. That is, mattress topper 30 may include one or a plurality of pockets 37*g* and/or one or a plurality of pockets 37*h*.

In some embodiments, mattress topper 30 may include one or a plurality of additional pockets 37 that is/are enclosed within at least one of pockets 37*a*, 37*b*, 37*c*, 37*d*, 37*e*, 37*f*, 37*g* and/or 37*h*. The additional pocket(s) 37 may be variously shaped, such as, for example, circular, oval, oblong, triangular, square, polygonal, irregular, uniform, non-uniform, offset, staggered, undulating, arcuate, variable and/or tapered.

In some embodiments, stitching 35 reduces the profile of stitched portions of panels 32, 32A to create different elevations of the fabric structure, so that there are highs and lows of profile that increase air circulation in around and through outer surfaces of panels 32, 32A, and between the outer surfaces of panel 32 and panel 32A.

Figure 2:
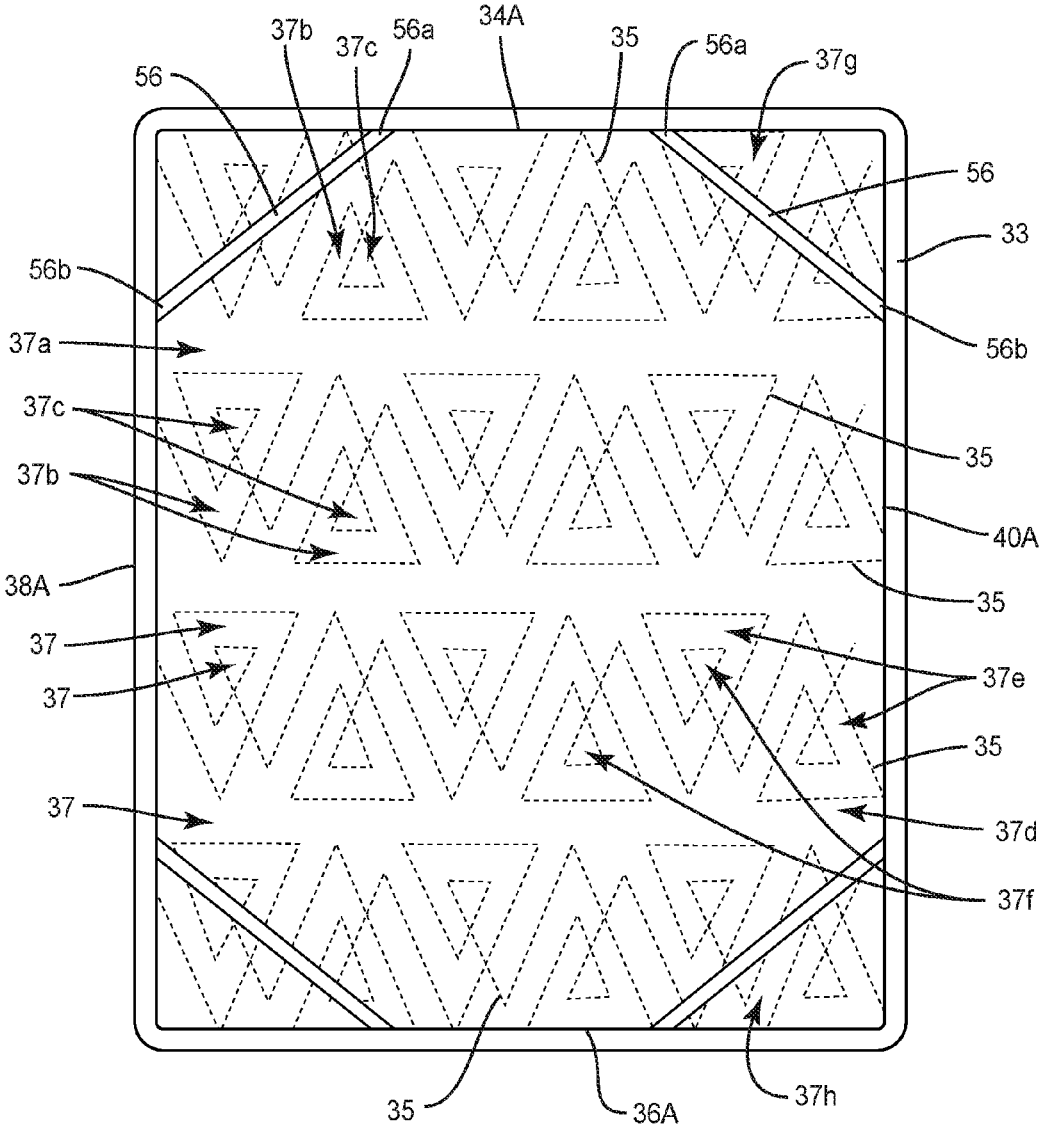
FIG. 2 is a bottom view of the mattress topper shown in FIG. 1.
Figure 3:
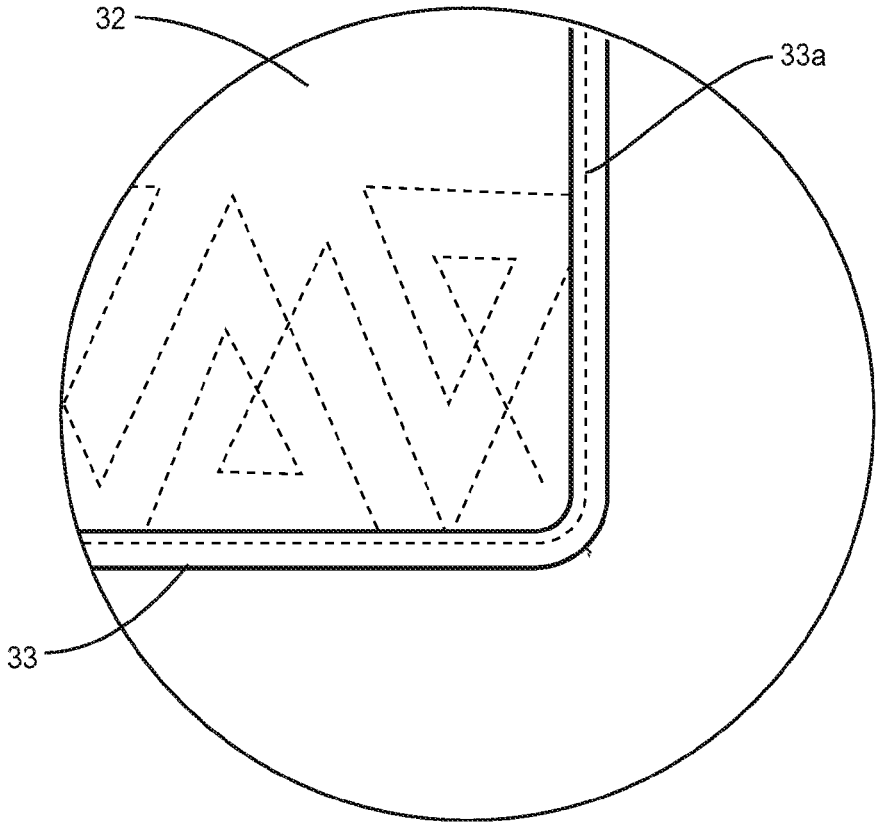
FIG. 3 is a top, close up view of a portion of the mattress topper shown in FIG. 1.

In some embodiments, mattress topper 30 comprises an anchor band, such as, for example, anchor band 56. In some embodiments, anchor band 56 comprises a first end 56*a* that is coupled to mattress topper 30 between surface 34A and binding 33 and an opposite second end 56*b* that is coupled to mattress topper 30 between surface 40A and binding 33, as shown in FIG. 2, for example. That is, anchor band 56 is positioned between an outer surface of panel 32A and an inner surface of binding 33. In some embodiments, anchor band 56 is configured to be positioned under a corner of a mattress.

In some embodiments, each corner of mattress topper 30 includes an anchor band 56. For example, in addition to the anchor band 56 described above, mattress topper 30 may include an anchor band 56 having a first end 56*a* that is coupled to mattress topper 30 between surface 34A and binding 33 and an opposite second end 56*b* that is coupled to mattress topper 30 between surface 38A binding 33. Anchor band 56 having a first end 56*a* that is coupled to mattress topper 30 between surface 36A and binding 33 and an opposite second end 56*b* that is coupled to mattress topper 30 between surface 38A and binding 33. Anchor band 56 having first end 56*a* that is coupled to mattress topper 30 between surface 36A and binding 33 and an opposite second end 56*b* that is coupled to mattress topper 30 between surface 40A and binding 33, as shown in FIG. 2. As such, anchor bands 56 may each be positioned under one of the corners of a mattress to secure mattress topper 30 to the mattress. As with the first anchor band 56 described above, the additional anchor bands 56 engage an outer surface of panel 32A and an inner surface of binding 33.

In some embodiments, at least one of anchor bands 56 comprises an elastic material, such as, for example, polyester and/or rubber. In some embodiments, anchor bands 56 are attached to panel 32A and binding 33 by positioning anchor bands 56 at a seam between panel 32A and binding 33. In some embodiments, anchor bands 56 are attached to panel 32A and binding 33 by sewing anchor bands 56 directly into a seam between panel 32A and binding 33. In some embodiments, anchor bands 56 are attached to panel 32A and binding 33 by stitching a box into panel 32A and/or binding 33 at ends 56*a*, 56*b* of anchor bands 56, wherein the stitching resembles a square box that then possesses an "X" shape within it. In this configuration, each final point on the radius of the "X" shape touches one respective interior corner of the square so that all four corners are thus connected to each other across the interior span of the square. This evenly distributes any pulling pressure from any tension on any of anchor bands 56 in all directions and across mattress topper 30. That is, it reduces or removes pressure from the seam between panel 32A and binding 33, thus reducing the likelihood of tearing mattress topper 30, and increasing overall grip, stability and durability of anchor bands 56. It is envisioned that at least one of anchor bands 56 may be positioned between panel 32 and binding 33 such that a first end of at least one of anchor bands 56 is positioned between one of surfaces 34, 36, 38, 40 and an inner surface of binding 33 and an opposite second end of at least one of anchor bands 36 is positioned between another one of surfaces 34, 36, 38, 40 and an inner surface of binding 33. In some embodiments, one or more of anchor bands 56 may be used to maintain mattress topper 30 in a rolled configuration for shipping and/or storage.

As discussed herein, panels 32, 32A have inner surfaces that face one another. The inner surfaces of panels 32, 32A define a cavity 50 of mattress topper 30 therebetween, as shown in FIG. 4. In some embodiments, cavity 50 may be configured for disposal of a fill material. In some embodiments, the fill material may be any material that provides cushioning and/or support for a sleeper that rests on top of mattress topper 30, without affecting the ability of a memory foam mattress that is positioned below mattress topper 30 to conform to the shape of a sleeper's body, as discussed above. In some embodiments, the fill material comprises a single layer of material. In some embodiments, the fill material comprises multiple layers of material. In some embodiments, the fill material comprises a compliant material. In some embodiments, the fill material comprises a non-compliant material. In some embodiments, the fill material comprises polyester fiber, wool, kapok, latex, foam, memory foam, feathers, gel, memory foam and/or combinations or blends of the same. In some embodiments, the fill material comprises a single piece of foam.

In some embodiments, the fill material has an uncompressed volume that is greater than an unexpanded volume of cavity 50. Due to the material(s) from which panels 32, 32A are made and the relative volumes of the fill material and cavity 50, cavity 50 may expand as the fill material is positioned in cavity 50. As cavity 50 expands, cavity 50 and/or mattress topper 30 assumes the general shape of the fill material. In some embodiments, mattress topper 30 includes at least some air between panels 32, 32A and the fill material. In some embodiments, panels 32, 32A engage the fill material such that there is no air between panels 32, 32A and the fill material. In some embodiments, the fill material is porous such that air in cavity 50 becomes trapped within the pores of the fill material. In some embodiments, air that is trapped within the pores of the fill material can exit mattress topper 30 through panels 32, 32A. In some embodiments, the fill material is removably positioned within cavity 50. In some embodiments, the fill material is secured within cavity 50 by stitching or some other means that fixes the fill material to at least one of panels 32, 32A.

Figure 5:
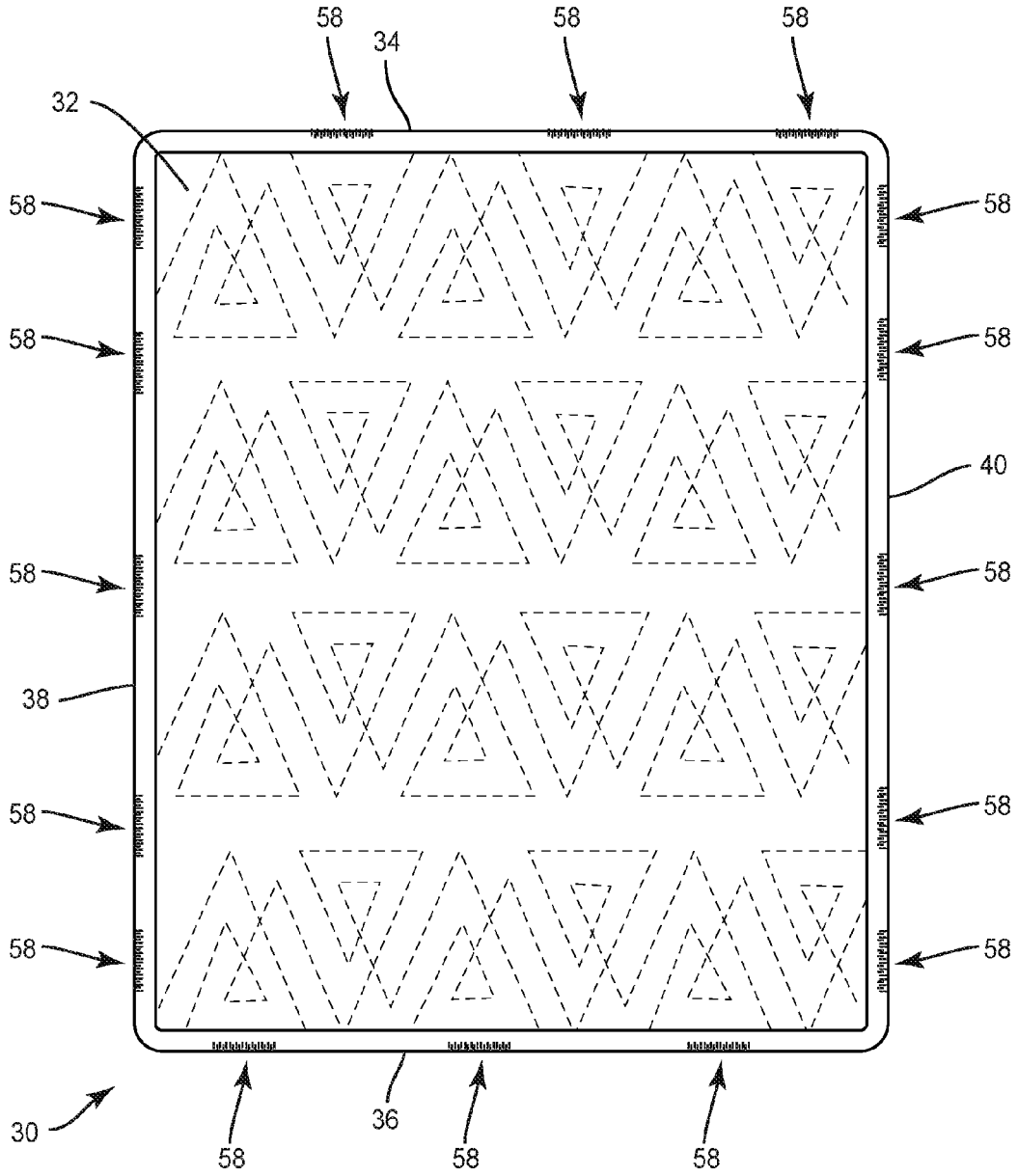
FIG. 5 is a top view of one embodiment of the mattress topper shown in FIG. 1 in accordance with the principles of the present disclosure.

In some embodiments, mattress topper 30 includes one or a plurality of ventilation zippers 58 in different zones to allow for different degrees of cushioning, warmth and/or ventilation, as shown in FIG. 5. For example, mattress topper 30 may include a plurality of ventilation zippers 58 that are spaced apart about mattress topper 30 thus allowing a sleeper the option to open one or more of the ventilation zippers 58, depending upon the desired amount of ventilation. As would be recognized by one of ordinary skill in the art, the more ventilation zippers that are opened, the quicker air can move from within mattress topper 30 to an area outside of mattress topper 30. Therefore, a sleeper can control the amount of ventilation provided by mattress topper 30 by selectively opening a desired number of ventilation zippers 58. For example, the sleeper can open additional ventilation zippers 58 when increased ventilation is required. In embodiments that include ventilation zippers 58, ventilation zippers 58, rather than stitching 33A join panel 32 to panel 32A at portions of mattress topper 30 that include ventilation zippers 58. Panel 32 is joined with panel 32A by stitching 33A as described above in other portions of mattress topper 30 that do not include ventilation zippers 58.

In some embodiments, one of surfaces 34, 36, 38, 40 of panel 32 includes a first portion of each ventilation zipper 58, such as, for example, a first set of teeth, and one surface 34A, 36A, 38A, 40A of panel 32A includes a second portion of each ventilation zipper 58, such as, for example, a second set of teeth. A first set of teeth of each ventilation zipper 58 engages a second set of teeth of the same ventilation zipper 58 to move ventilation zipper 58 between open and closed configurations. When ventilation zippers 58 are in the open configurations, ventilation zippers 58 allow access to cavity 50 and/or at least one of pockets 37*a*, 37*b*, 37*c*, 37*d*, 37*e*, 37*f*, 38*g* from outside of mattress topper 30. When ventilation zippers 58 are in the closed configurations, ventilation zippers 58 prevent access to cavity 50 and/or at least one of pockets 37*a*, 37*b*, 37*c*, 37*d*, 37*e*, 37*f*, 38*g* from outside of mattress topper 30. When ventilation zippers 58 are in the open configurations, thermal release and air flow between cavity 50 and/or at least one of pockets 37*a*, 37*b*, 37*c*, 37*d*, 37*e*, 37*f*, 38*g* and the environment surrounding mattress topper 30 is increased, thus allowing for increased ventilation. When ventilation zippers 58 are in the closed configurations, thermal release and air flow between cavity 50 and/or at least one of pockets 37*a*, 37*b*, 37*c*, 37*d*, 37*e*, 37*f*, 38*g* and the environment surrounding mattress topper 30 is reduced or prevented, thus allowing for increased insulation.

Figure 6:
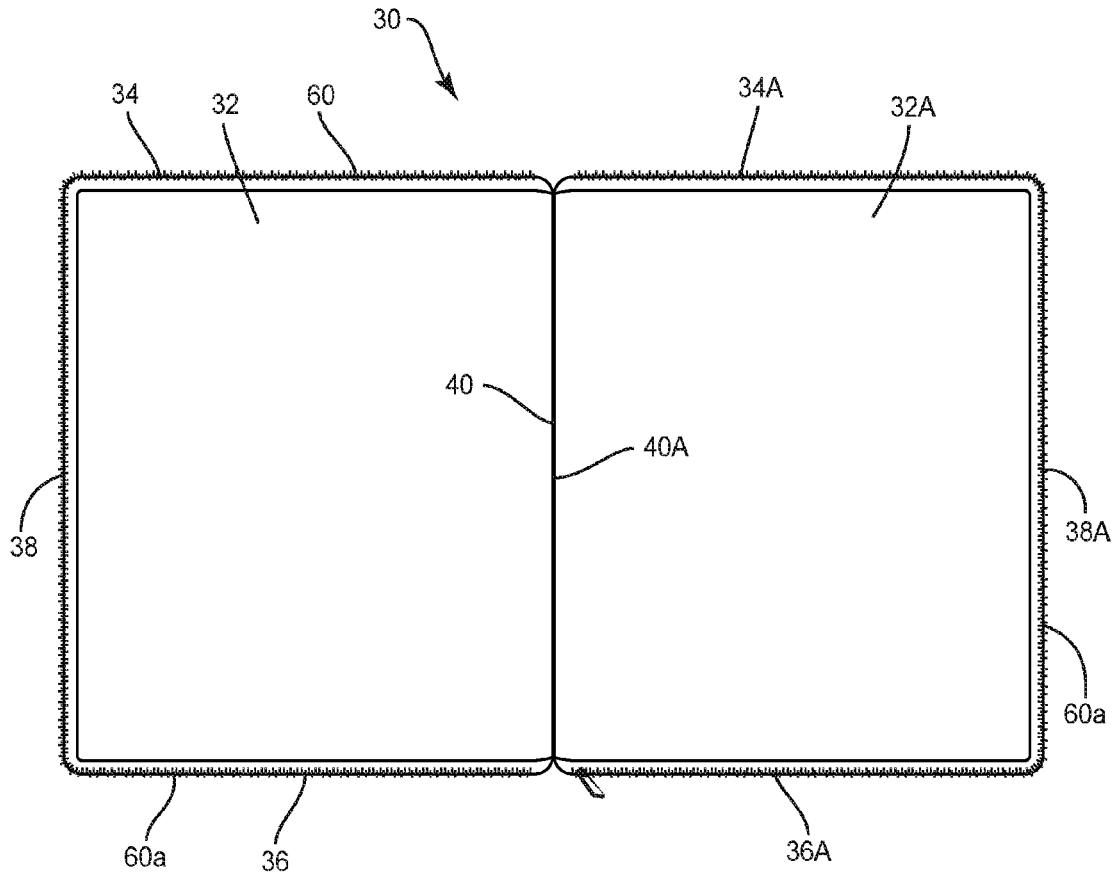
FIG. 6 is a top view of one embodiment of the mattress topper shown in FIG. 1 in accordance with the principles of the present disclosure.

In some embodiments, stitching 33A extends through surfaces 40, 40A without extending through surfaces 34, 36, 38, 34A, 36A, 38A and stitching 35 extends through panel 32 without extending through panel 32A and/or extends through panel 32A without extending through panel 32. In such embodiments, panel 32 comprises a first portion of a fastener, such as, for example, a zipper 60 (FIG. 6), and panel 32A comprises a second portion of a fastener, such as, for example, zipper 60. As shown in FIG. 6, panel 32 comprises a first set of teeth 60*a* of zipper 58. Teeth 60*a* extend along surfaces 34, 36, 38. Teeth 60*a* do not extend along any portion of surface 40, as shown in FIG. 6. Panel 32A comprises a second set of teeth 60*b* of zipper 60. Teeth 60*b* extend along surfaces 34A, 36A, 38A. Teeth 60*a* do not extend along any portion of surface 40A, as shown in FIG. 6. This provides zipper 60 with a substantially "U" shape that extends along both short sides of mattress topper 30 (e.g., the side defined by surfaces 34, 34A and the side defined by surfaces 36, 36A) and one long side of mattress topper 30 (e.g., the side defined by surfaces 38, 38A). Zipper 60 is configured to move mattress topper 30 from a closed position, shown in FIGS. 1 and 2, in which teeth 60*a* engage teeth 60*b* and there is no access to cavity 50, to an open position, shown in FIG. 6, in which teeth 60*a* are spaced apart from teeth 60*b* to provide access to cavity 50. In some embodiments, teeth 60*a* are sewn to surfaces 34, 36, 38 and teeth 60*b* are sewn to 34A, 36A, 38A. This configuration allows gusset 44 to be exposed when zipper 60 is in the open configuration to allow for increased ventilation and also results in increased insulation when zipper 60 is in the closed configuration. In some embodiments, a mattress, such as, for example, an air mattress or couch mattress may be positioned between panels 32, 32A when zipper 60 is in the open configuration. Zipper 60 may then be moved from the open configuration to the closed configuration to enclose the mattress within mattress topper 30.

In some embodiments, mattress topper 30 may include a heating and/or cooling element within cavity 50 and/or within at least one of pockets 37*a*, 37*b*, 37*c*, 37*d*, 37*e*, 37*f*, 38*g* to allow a sleeper to match the temperature of cavity 50 and/or at least one of pockets 37*a*, 37*b*, 37*c*, 37*d*, 37*e*, 37*f*, 38*g* according to his or her sleep preference. In some embodiments, the sleeper can set the heating and/or cooling element to regulate the temperature within cavity 50 and/or at least one of pockets 37*a*, 37*b*, 37*c*, 37*d*, 37*e*, 37*f*, 38*g* to a desired temperature such that if the temperature within cavity 50 and/or at least one of pockets 37*a*, 37*b*, 37*c*, 37*d*, 37*e*, 37*f*, 38*g* deviates from the set temperature, the heating and/or cooling element will increase or decrease the temperature within cavity 50 and/or at least one of pockets 37*a*, 37*b*, 37*c*, 37*d*, 37*e*, 37*f*, 38*g*. In some embodiments, the heating and/or cooling element is a thermoelectric device that is capable of heating and cooling air.

In some embodiments, mattress topper 30 may include one or more channels, such as, for example, open air channels that allow for cooling and/or heating. In some embodiments, at least one of the channels is defined by one or more of pockets 37. That is, the channels are the space within pockets 37. In some embodiments, the channels are configured to bring cool air from the room environment across the upper surface of mattress topper 30 (e.g., the outer surface of panel 32) and through the material that defines the channels and pockets 37 to provide additional ventilation for temperature-regulation to the sleeper, which may result in a cooler feeling, or alternately, when desired, a warmer feeling. In some embodiments, the cooler feeling and the warmer feeling is due to the air temperature of the room environment in which mattress topper 30 is positioned. In some embodiments, the warmer feeling is due to a heating element that is embedded in mattress topper 30. In some embodiments, one or more heating elements are positioned within one or more of the channels. In some embodiments, the cooler feeling and/or the warmer feeling is created by temperature-regulating materials. In some embodiments, the temperature-regulating materials are embedded in mattress topper 30. In some embodiments, the temperature-regulating material is embedded within one or more of the channels.

In some embodiments, the channels are positioned between panels 32, 32A. In some embodiments, the channels are defined at least in part by vertical supports that are positioned between panels 32, 32A. The vertical supports are configured to prevent the channels from being compressed by the dispersed weight of the reclined sleeper to allow a continuous flow of air from the room environment into and through the channels. In some embodiments, the vertical supports are made from plastic. In some embodiments, an upper surface of each of the vertical supports engages the inner surface of panel 32 and a lower surface of each of the vertical supports engages the inner surface of panel 32A. In some embodiments, at least one of the channels is defined by the inner surfaces of panels 32, 32A and the inner surfaces of the vertical supports such that air from the sleep surface can enter the channels through panel 32 and/or panel 32A. This allows the air from the sleep surface to move continuously through the channels, thus preventing the air from becoming trapped within mattress topper 30 and causing discomfort to the sleeper.

In some embodiments, the channels can have various shape configurations, such as, for example, circular, oval, oblong, square, rectangular, polygonal, irregular, uniform, non-uniform, variable and/or tapered. In some embodiments, one or more of the channels has an end that adjacent to an edge of at least one of panels 32, 32A such that air from the room environment can enter the channels and move laterally through the channels to provide ventilation. In some embodiments, mattress topper 30 is configured such that one or more of the channels extends from one edge of at least one of panels 32, 32A (e.g., surface 38 or surface 34) to another edge of at least one of panels 32, 32A, such as, for example, an opposite edge of at least one of panels 32, 32A (e.g., surface 40 or surface 36). This configuration air from the room environment to move continuously from one side or end of mattress topper 30 to an opposite side or end of mattress topper 30 such that the air can exit mattress topper 30 on the opposite side or end from where the air entered using a single channel. The air will provide a warm or cool feel to a sleeper that is resting upon mattress topper 30 as the air moves through the channel.

In some embodiments, at least one of the channels includes a top surface that engages the inner surface of panel 32, a bottom surface that engages the inner surface of panel 32A and spaced apart side surfaces that that each extend from the top surface to the bottom surface such that the channels resemble a hollow tube The channels include openings at opposite ends of the channel. This configuration prevents air from the sleep surface from entering the channels such that the air in the room environment will flow continuously through mattress topper 30.

In some embodiments, the channels are spaced apart from one another such that air in one channel cannot enter another channel. In some embodiments, at least one of the channels is in communication with at least one of the other channels such that air in one of the channels can enter another one of the channels.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A mattress topper comprising:

opposite first and second end surfaces, the end surfaces each extending from a first side surface to a second side surface, wherein the mattress topper comprises a quilting pattern defining a first pocket that extends from the first side surface to the second side surface, a second pocket that is enclosed within the first pocket and a third pocket that is enclosed within the second pocket, wherein the mattress topper comprises a fourth pocket that extends from the first side surface to the second side surface, a fifth pocket that is enclosed within the fourth pocket and a sixth pocket that is enclosed within the fifth pocket, wherein the mattress topper has a rectangular configuration including four corners; and anchor bands extending across each of the corners, first ends of the anchor bands being coupled to one of the end surfaces and second ends of the anchor bands being coupled to one of the side surfaces, wherein at least one of the pockets comprises a thermoelectric device positioned therein, the thermoelectric device being capable of heating and cooling air.

2. A mattress topper as recited in claim 1, wherein the mattress topper comprises a plurality of the first pockets, a plurality of the second pockets and a plurality of the third pockets.

3. A mattress topper as recited in claim 1, wherein the mattress topper comprises stitching that is positioned about a perimeter of the mattress topper defined by the end surfaces and the side surfaces.

4. A mattress topper as recited in claim 3, wherein the stitching defines a portion of the quilting pattern, the portion of the quilting pattern defining opposite first and second ends of the first pockets.

5. A mattress topper as recited in claim 1, wherein:

the mattress topper comprises a first panel and a second panel; and the quilting pattern is defined by stitching that extends through each of the panels such that the quilting pattern is visible on each of the panels.

6. A mattress topper as recited in claim 5, wherein the quilting pattern appears identical on each of the panels.

7. A mattress topper as recited in claim 5, wherein inner surfaces of the panels define a cavity having a fill material disposed therein.

8. A mattress topper as recited in claim 5, wherein:

inner surfaces of the panels define a cavity having a fill material disposed therein; and the quilting pattern is defined by stitching that extends through each of the panels and the fill material such that the quilting pattern is visible on each of the panels.

9. A mattress topper as recited in claim 5, wherein the first panel comprises a first material and the second panel comprises a second material that is different from the first material.

10. A mattress topper as recited in claim 9, wherein the first material is a breathable fabric and the second material is a double layered 3D mesh fabric.

11. A mattress topper as recited in claim 1, wherein the fourth pocket abuts the first pocket.

12. A mattress topper as recited in claim 1, wherein mattress topper comprises a plurality of the fifth pockets and a plurality of the sixth pockets, the fifth pockets being enclosed within the fourth pocket and the sixth pockets each being enclosed within one of the fourth pockets.

13. A mattress topper as recited in claim 12, wherein at least one of the fifth pockets is positioned between two of the sixth pockets.

14. A mattress topper as recited in claim 1, wherein at least one of the anchor bands comprises an elastic material made from polyester and rubber.

15. A mattress topper as recited in claim 1, wherein the first pocket includes a plurality of first pockets, at least one of the side surfaces comprises a plurality of spaced apart zippers, each of the zippers defining an opening when the zippers are in an open configuration, the openings being in communication with one of the first pockets.

16. A mattress topper as recited in claim 1, wherein the thermoelectric device is positioned within the first pocket.

17. A mattress topper as recited in claim 1, wherein the thermoelectric device is positioned within the third pocket.

18. A mattress topper as recited in claim 1, wherein:

the mattress topper comprises a first panel and a second panel; and the second panel is attached to the first panel by stitching that extends only around perimeters of each of the panels.

19. A sleep system comprising:

a mattress comprising a bottom surface and an opposite top surface; and a mattress topper comprising:

a first panel and an opposite second panel that is positioned atop and engages the top surface of the mattress, the panels each comprising opposite first and second end surfaces, the end surfaces of the first panel each extending from a first side surface to a second side surface of the first panel, the end surfaces of the second panel each extending from a first side surface to a second side surface of the second panel, wherein the mattress topper comprises a quilting pattern defining a first pocket that extends from the first side surfaces to the second side surfaces, a second pocket that is enclosed within the first pocket and a third pocket that is enclosed within the second pocket, wherein the mattress topper comprises a fourth pocket that extends from the first side surface to the second side surface, a fifth pocket that is enclosed within the fourth pocket and a sixth pocket that is enclosed within the fifth pocket, wherein the mattress topper has a rectangular configuration including four corners, and anchor bands extending across each of the corners, first ends of the anchor bands being coupled to one of the end surfaces and second ends of the anchor bands being coupled to one of the side surfaces, wherein at least one of the pockets comprises a thermoelectric device positioned therein, the thermoelectric device being capable of heating and cooling air, wherein a top surface of the first panel defines a sleep surface configured to accommodate a sleeper such that heated air from the sleep surface moves into the pockets, the heated air being at least partially trapped within the pockets to prevent or reduce an increase in temperature of the sleep surface, and wherein the heated air within the pockets will move through at least one of the first panel and the second panel and into an environment having an ambient temperature that is less than a temperature of the heated air within the pockets to lower the temperature of the heated air within the pockets to prevent the mattress topper from becoming too warm.

20. A mattress topper comprising:

opposite first and second end surfaces, the end surfaces each extending from a first side surface to a second side surface, the mattress topper comprising a plurality of rows, each of the rows comprising a quilting pattern defining a first pocket that extends from the first side surface to the second side surface, a second pocket that is enclosed within the first pocket and a third pocket that is enclosed within the second pocket, wherein each of the rows comprises only one of the first pockets, a plurality of the second pockets and a plurality of the third pockets, the mattress topper comprising stitching that is positioned about a perimeter of the mattress topper, the perimeter being defined by the end surfaces and the side surfaces the mattress topper having a rectangular configuration including four corners, and anchor bands extending across each of the corners, first ends of the anchor bands being coupled to one of the end surfaces and second ends of the anchor bands being coupled to one of the side surfaces, wherein at least one of the rows comprises a fourth pocket that extends from the first side surface to the second side surface, a fifth pocket that is enclosed within the fourth pocket and a sixth pocket that is enclosed within the fifth pocket, the at least one of the rows comprising a single fourth pocket, a plurality of the fifth pockets and a plurality of the sixth pockets, wherein the fourth pocket abuts at least one of the first pockets, wherein at least one of the pockets comprises a thermoelectric device positioned therein, the thermoelectric device being capable of heat and cool air if a temperature within a respective one of the pockets deviates from a temperature selected by a user, wherein the mattress topper comprises stitching that is positioned about a perimeter of the mattress topper that is defined by the end surfaces and the side surfaces, the stitching defining a portion of the quilting pattern, the portion of the quilting pattern defining opposite first and second ends of the first pocket and opposite first and second ends of the fourth pocket, and wherein the quilting pattern is defined by stitching that extends through each of the panels such that the quilting pattern appears identical on each of the panels.

* * * * *